US005980317A

United States Patent [19]

McNeel

[11] Patent Number: 5,980,317

[45] Date of Patent: Nov. 9, 1999

[54] REPAIRABLE ELECTRICAL GEOPHYSICAL CONNECTOR

[75] Inventor: William O. McNeel, Houston, Tex.

[73] Assignee: Geo Space Corporation, Houston, Tex.

[21] Appl. No.: 09/039,097

[22] Filed: Mar. 13, 1998

[51] Int. Cl.[6] ..... H01R 13/40

[52] U.S. Cl. ..... 439/589; 439/281

[58] Field of Search ..... 439/589, 148, 439/281, 282

[56] References Cited

U.S. PATENT DOCUMENTS

| | | | |
|---|---|---|---|
| 4,731,032 | 3/1988 | Noorily | 439/136 |
| 5,295,866 | 3/1994 | Kroger et al. | 439/589 |
| 5,387,119 | 2/1995 | Wood | 439/589 |
| 5,458,507 | 10/1995 | Colescott et al. | 439/589 |
| 5,470,248 | 11/1995 | Wood . | |
| 5,711,685 | 1/1998 | Wood . | |

*Primary Examiner*—Steven L. Stephan
*Assistant Examiner*—Hae Moon Hyeon

[57] ABSTRACT

An electrical geophysical connector comprising an outer housing, a first connection member and a second connection member. First and second coacting electrical contacts are positioned in the first and second members, respectively. The first member includes a rigid outer shell and a resilient inner core bonded to the first electrical contacts. The first ends of the first contacts are positioned in cavities located in one end of the inner core and resilient seal rings are formed about the cavities for engaging and sealing the coacting engagement of the first and second contacts. A dust cap is rotatably mounted with a 360° rotation to the housing and the exterior of the housing is tri-lobed in cross section for ease of gripping.

2 Claims, 3 Drawing Sheets

REPAIRABLE ELECTRICAL GEOPHYSICAL CONNECTOR

FIELD OF THE INVENTION

This invention provides a means by which a geophysical connector can easily be disassembled in the field, new parts inserted and wired, and reassembled with a minimum of down time and cost. A connector of this design can be used in all environments, such as dry land or underwater, Arctic or desert locations.

BACKGROUND OF THE INVENTION

In seismic exploration, conditions dictate that electrical cables and attached connectors must withstand the rigors of hot, cold, dry and wet environments and be well constructed for years of field service. A long standing field problem has always been the routine repair and upkeep of the cables and connectors. Most generally, geophysical connectors which were to be used in a water environment were of the single molded type construction in order to maintain a waterproof sealed and moisture free assembly. However, a connector, such as this, ability to be repaired to its original condition is questionable. Single molded type connectors that are used in the wet environment, most generally, by its design have mating surfaces of a relatively soft elastomeric material which engage, face to face, with a relative hard mating member connector to provide a waterproof, moisture free assembly that maintains a minimum resistance path to all internal electrical conductive components. If a repaired cable with attached electrical connectors cannot meet this requirement, then the cable must be removed from service.

A single molded type of electrical connector construction usually has a one piece body member which is molded from soft elastomeric material. This body internally houses a plurality of pins, in a designed fixed pattern, within individual cavities that communicate with its mating, hard body, connector, sealing and excluding moisture from around the pins or socket. An electrical cable which has a plurality of electrical insulated conductors, that attach to the individual electrical pins, must also be molded within the body member. The outer jacket insulator of the electrical cable is generally an extruded soft, urethane material which satisfactorily forms a sealed bond between the electrical cable's outer insulating jacket and the body member that prevents and excludes moisture from entering within.

However, due to the extreme harsh handling that the cables and connectors are subjected to in the field, damage to the cables and connectors occur. Since the electrical pins are molded within the body member in a soft, relatively pliable material, over a period of time and continuous service, the pins are subjected to movement, when mating occurs, or they misalign eventually causing separation of the bonding material from around the pins. When this event eventually happens, it presents a passageway for moisture to enter within, increasing the possibility of devastating electrical leakage.

Another type of repairable electrical connector is shown in U.S. Pat. No. 5,470,248 in which rigid male and female members are joined together by a resiliently compressible coupling member.

SUMMARY

The present invention is directed to a sealed, field repairable electrical geophysical connector which overcomes many of the disadvantages, as described above, of the single molded construction as well as other types of connectors. The present invention can easily be disassembled if problems exist, repaired and reassembled in the field with a minimum of down time and used in any and all exploration environments.

A further object of the present invention is the provision of an electrical geophysical connector having an outer housing, a first connection member releasably secured in the housing and a second connection member releasably secured to the housing. First and second coacting electrical contacts are provided, one of which is male and the other of which is female, positioned in the first connection member and the second connection member, respectively. The first connection member includes a rigid, outer shell and an inner, resilient core bonded thereto having a first end including a plurality of cavities. The first contacts are positioned in and bonded to the inner core in which the first ends are positioned in one of the cavities and the second ends extend out of the second end of the core. A second connector member includes a rigid shell enclosing the second contacts whose ends extend out of the ends of the rigid shell. The inner core of the first connector forms a plurality of sealing rings around each of the cavities for sealing the coacting electrical contacts.

Yet a further object of the present invention is wherein the exterior of the outer housing is tri-lobed in cross section for ease of gripping.

Still a further object is wherein the first contacts are male pins and the second contacts are female receptacles.

Yet a still further object of the present invention is the provision of a dust cap releasably attached to the outer housing and connected to a line attached to an anchor which is 360° rotatable relative to the housing.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1:
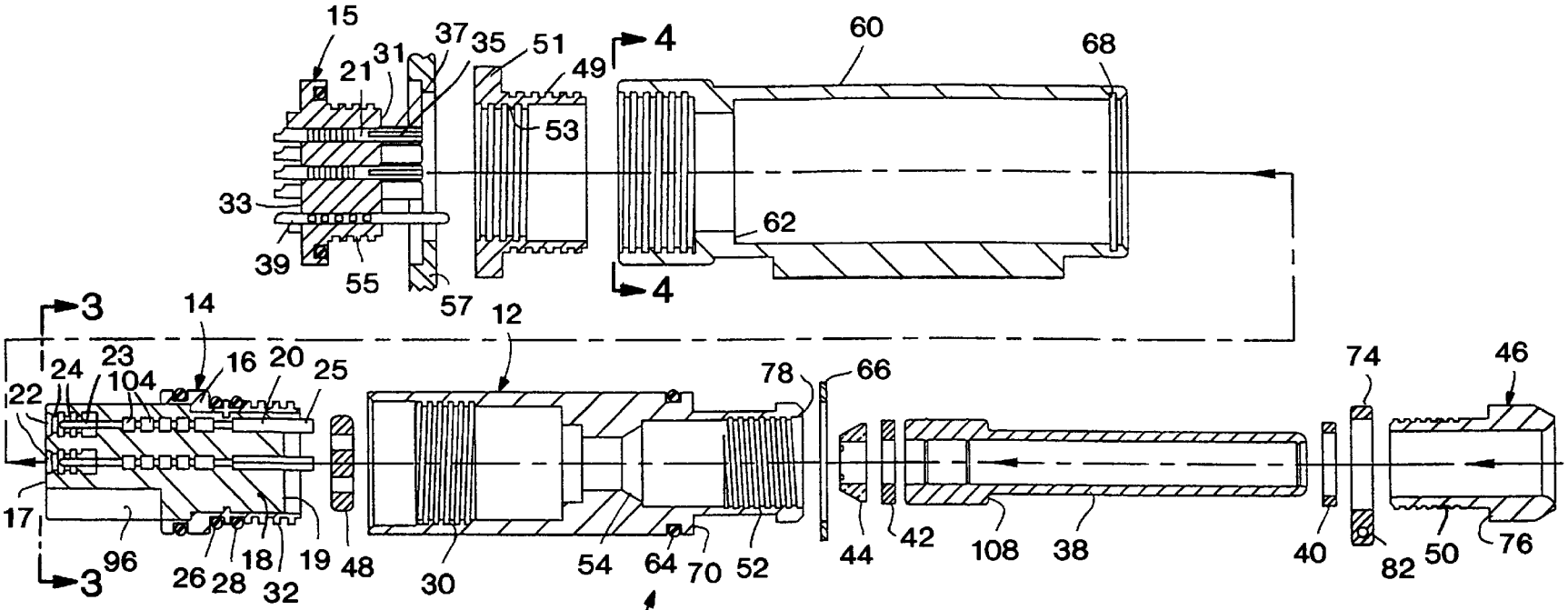
FIG. 1 is an elevational view, in cross section, of the present invention in an exploded view.
Figure 2:
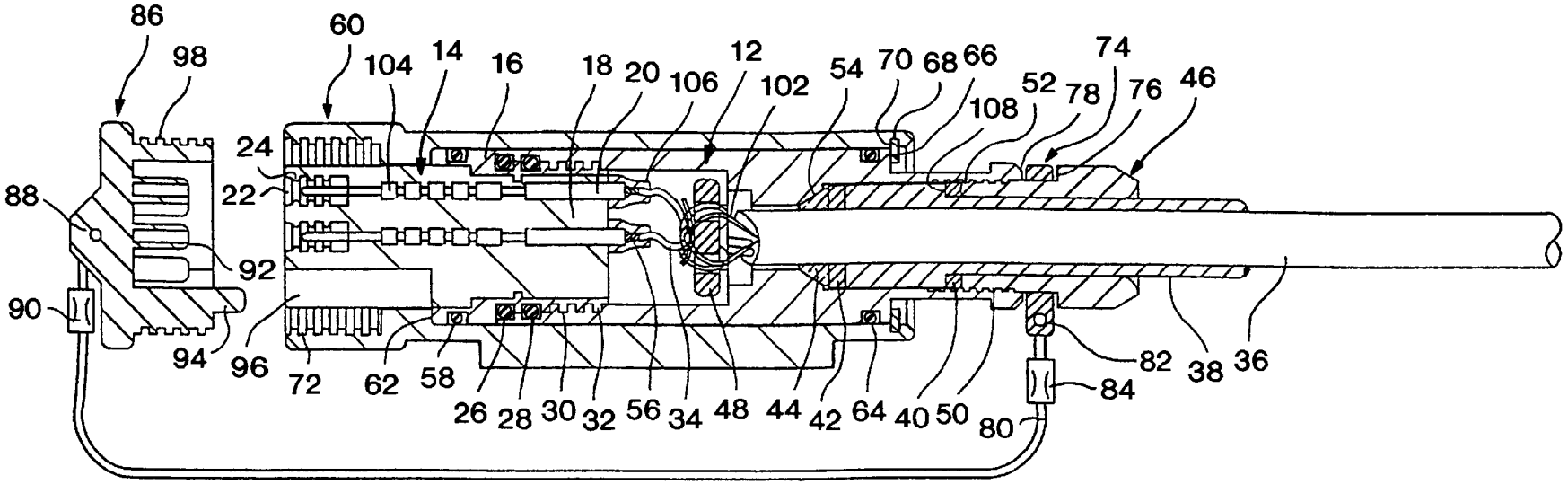
FIG. 2 is an elevational cross section of one of the connector members of the present invention assembled with an attached disconnected dust cover.

Referring now to the drawings, and particularly to FIGS. 1 and 2, the reference numeral 10 generally indicates the geophysical connector of the present invention and generally includes an outer housing 60, a first connector member 14 releasably securable in the housing 60, and a second connector member 15 releasably securable to the housing 60.

First and second coacting electrical contacts 20 and 21, one of which is male and the other of which is female, are positioned in the first connector member 14 and the second connector member 15, respectively. That is, for purposes of illustration, the first member 14 is shown as a male connector member having male electrical contacts, such as pins 20 and the second electrical connector 15 is shown as the female connector having female electrical contacts such as receptacles 21.

Obviously, the coacting electrical contacts in the connectors 14 and 15 could be reversed.

The first male connector member 14 includes a rigid outer shell such as an injection molded hard non-conductive glass filled urethane outer shell 16 and a resilient inner core 18 bonded to the outer shell 16 such as any suitable relatively soft non-conductive injection molded core, such as of a low durometer urethane material. The core 18 includes a first end 17 and a second end 19 and the first end 17 includes a plurality of cavities 22. The first electrical contacts are pins 20 positioned in and bonded to the inner core 18 and include a plurality of outwardly extending annular rings 104 to improve the sealing capability, urethane to metal, and pins 20 retention within the male connector member 14. The first contacts pins 20 include first ends 23 and second ends 25. The first end 23 of the pins 20 are positioned in one of the cavities 22. The second ends 25 of the first electrical contacts extend out of the second end 19 of the core 18 for attachment to an electrical cable.

The male connector member 14 is releasably secured to the housing 60 through a body member 12. A threaded section 32 of the outer shell 16 is disposed at one end and adapted to mate with the internal threaded section 30 of the body 12 securing the two parts in rigid engagement. Two O rings 26 and 28 hermetically seal the male connector member 14 to the body member 12.

Figure 3:
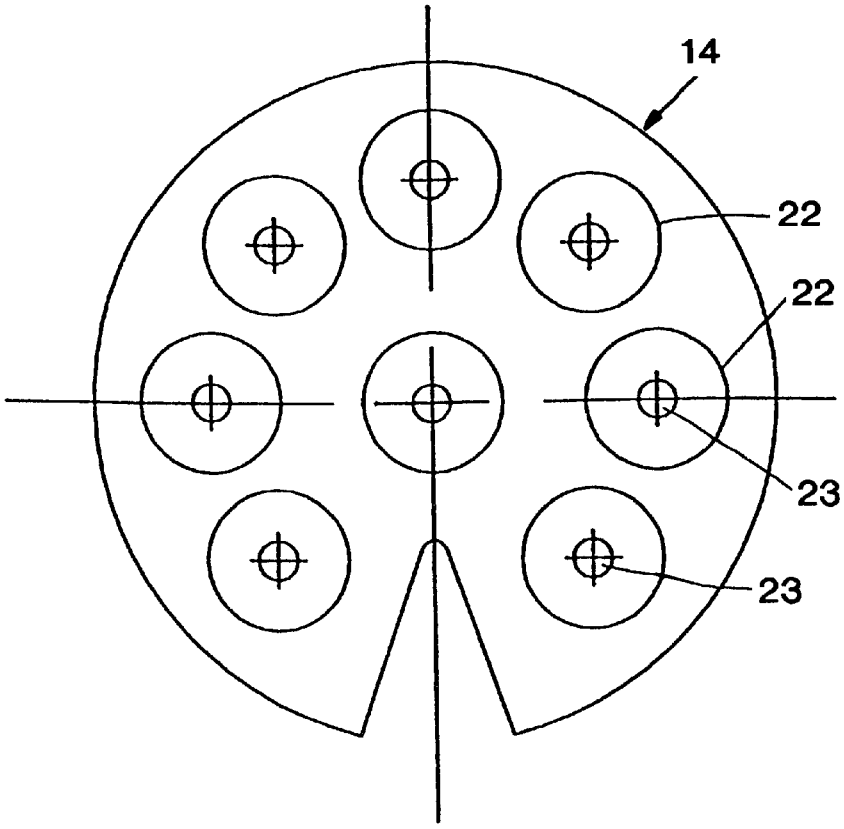
FIG. 3 is a cross-sectional view taken along the line 3—3 of FIG. 1.

Referring now to FIG. 1, the second, or female, connector member 15 is comprised of a rigid shell having a first end 31 and a second end 33. The second electrical contacts 21 are positioned in the connector 15 and include ends extending out of the first end 31 and the second end 33 of the rigid shell of the second connector 15. One of the ends 35 of the receptacles 21 include an outer electrically non-conductive covering 37 and the ends 35 are adapted to be inserted into the cavities 22 of the male connector 14 to engage the ends 23 of the pins 20 to provide an electrical connection between the connectors 14 and 15. It is to be noted that a plurality of internal sealing rings 24 are formed by the inner core 18 of the connector 14 around each of the cavities 22 for sealing the coacting electrical contacts 20 and 21. The ends of the electrical receptacles 21 extending out of the end 33 of the connector 15 are suitably connected to an electrical cable. The receptacle 15 additionally includes a locator key 39 for engagement with a female locator key 96 (FIG. 3) in the electrical connector 14 for correctly aligning and mating the electrical contacts 20 and 21.

Referring now to FIG. 2, the male connector member 14 is adapted to be connected to a plurality of electrical wires 34 from within an electrical cable 36 preferably by a hard wire connection such as soldering. A cable seal 38 is preferably formed of an injection moldable resiliently compressible material such as a thermoplastic rubber which seals against the outside of the cable 36. A compression anchor spacer 42 is positioned and abuts the face of the cable seal 38. A compression spacer 40 is positioned on the rear shoulder 108 of the cable seal 38. Positioned directly ahead of compression anchor spacer 42 is a collapsible cable anchor 44. Seal screw 46 has a plurality of external threads 50 which are adapted to mate with a plurality of internal threads 52 of the body member 12. As the seal screw 46 is secured within the threaded engagement, pressure is exerted against compression spacer 40 which in turn compresses the cable seal 38. The compression anchor spacer 42 is forced against the cable anchor 44 driving it into a tapered receiving counterbore 54 whereby cable anchor 44 having its diameter reduced in size bites into the outside of the electrical cable 36 virtually locking the cable 36 in a secured position relative to the body member 12. Cable seal 38 which is captured between the compression spacer 40 and compression anchor spacer 42, expands under compression, both internally sealing the jacket of the electrical cable 36 and externally sealing the entrance to the body member 12.

The strain anchor 48 is a means to secure the cable stress member 102, and cable conductor wires 34. The cable stress member 102, such as impregated KEVLAR, is most generally located within the center of the electrical cable 36. When electrical cables, of long lengths, are subjected to tension there is a tendency for the electrical wires 34 to stretch and move internally breaking the electrical connections at the solder connection 56. However, with stress member 102 and cable conductor wires 34 firmly attached to the strain anchor 48 damage is kept to a minimum. Shrink tubing 106 with internal adhesive that makes a positive seal between the electrical pin 20 and the outer insulation of the cable conductor wires 34. Seal screw 46, compression spacer 40, compression anchor spacer 42, cable anchor 44 and strain anchor 48 preferably are injection molded hard, rigid, non-conductive glass filled urethane material.

Figure 4:
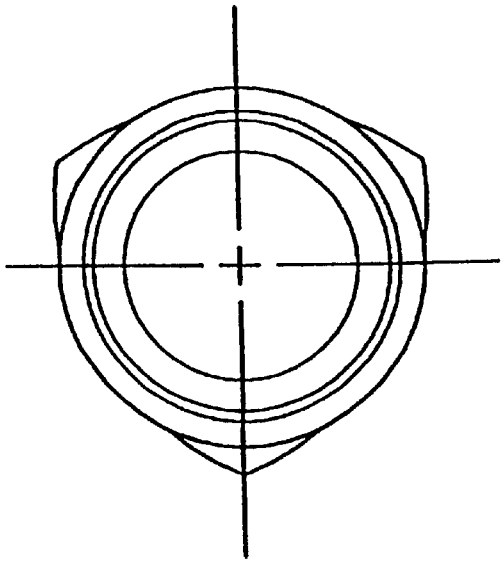
FIG. 4 is a cross-sectional view taken along the line 4—4 of FIG. 1.

The assembled body member 12, as shown in FIGS. 1 and 2, is inserted into the housing 60 and is positioned to stop at shoulder 62. O rings 58 and 64 are positioned in light engagement to prevent the internal area between the housing 60 and body member 12 from filling with fine sand or mud. Spiral lock ring 66 is inserted into an internally disposed groove 68 and engages shoulder 70 of the body member 12. A plurality of internal threads 72 of housing 60 disposed at one end are adapted to mate with a plurality of external threads 49 of an adapter 51 (FIG. 1) which in turn threadably engages the mating connector 15 by coacting threads 53 and 55 through a wall 57. The housing 60, as shown in FIG. 4, has a three lobed arrangement to aid in gripping and turning during assembly or disassembly of the connector.

A wire rope anchor 74 is disposed between the shoulder 76 of the seal screw 46 and shoulder 78 of the body member 12. The wire rope anchor 74 is free to rotate 360°. Attached to the wire rope anchor 74, a stainless steel jacked wire rope 80 is inserted through the hole 82 of the wire rope anchor 74 and secured with a clamp 84. Attached to the opposite end of the wire rope 80 is an injection molded dust cover 86 preferably a hard, rigid, glass filled urethane material. Wire rope 80 is secured to the dust cover 86 through hole 88 and secured with a clamp 90.

Dust cover 86 has a plurality of mating pins 92 which engage the cavities 22 of the male connector member 14 for sealing purposes when the cable is not in service. A male key 94 on the dust cover 86 projects outwardly and engages the female key 96 on the male connector member 14 which orients and positions all mating pins 92. A plurality of external threads 98 of the dust cover 86 engage and mate with a plurality of internal threads 72 of the housing 60.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts may be made which will readily suggest themselves to those skilled in the art and which are encompassed within the spirit of the invention and the scope of the appended claims.

What is claimed is:

1. An electrical geophysical connector, comprising, an outer housing, a first connection member releasably secured in the housing, and a second connection member releasably secured to the housing, first and second coacting electrical contacts, one of which is male and the other of which is female, positioned in first connection member and the second connection member, respectively, said first connection member having a rigid outer shell and a resilient inner core bonded thereto and having first and second ends, said first end including a plurality of cavities, said first contacts positioned in and bonded to the inner core and include first and second ends, the first ends of each of the first contacts positioned in one of the cavities, the second ends of the first contacts extending out of the second end of the core for attachment to an electrical cable, said second connection member including a rigid shell having first and second ends, and said second contacts positioned in the second connection and having ends extending out of the first and second ends of the rigid shell of the second connector, respectively, one of the ends of the second contacts adapted to be inserted into the cavities of the first connection member and engage the first ends of the first contacts, said inner core of the first connector forming a plurality of sealing rings around each of the cavities for sealing the coacting electrical contacts, and wherein the exterior of the outer housing is tri-lobed in cross section for ease of gripping.

2. An electrical geophysical connector, comprising, an outer housing, a first connection member releasably secured in the housing, and a second connection member releasably secured to the housing, first and second coacting electrical contacts, one of which is male and the other of which is female, positioned in first connection member and the second connection member, respectively, said first connection member having a rigid outer shell and a resilient inner core bonded thereto and having first and second ends, said first end including a plurality of cavities, said first contacts positioned in and bonded to the inner core and include first and second ends, the first ends of each of the first contacts positioned in one of the cavities, the second ends of the first contacts extending out of the second end of the core for attachment to an electrical cable, a body member sealably and releasably connected to the rigid outer shell and sealably and releasably connected to the outer housing and having a cavity enclosing the second ends of the first contacts, a strain anchor positioned in the cavity for connection between the electrical cable and the second ends of the first contacts, a cable seal and anchor releasably connected to the body member for sealably and releasably attaching to said electrical cable, said second connection member including a rigid shell having first and second ends, and said second contacts positioned in the second connection and having ends extending out of the first and second ends of the rigid shell of the second connector, respectively, one of the ends of the second contacts adapted to be inserted into the cavities of the first connection member and engage the first ends of the first contacts, and said inner core of the first connector forming a plurality of sealing rings around each of the cavities for sealing the coacting electrical contacts.

* * * * *